US007368875B2

(12) United States Patent
Minami et al.

(10) Patent No.: US 7,368,875 B2
(45) Date of Patent: May 6, 2008

(54) DISCHARGE LAMP LIGHTING DEVICE

(75) Inventors: Fumihiro Minami, Tokyo (JP); Takashi Ohsawa, Tokyo (JP); Kinsho Ando, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 290 days.

(21) Appl. No.: 10/895,336

(22) Filed: Jul. 21, 2004

(65) Prior Publication Data

US 2005/0017653 A1 Jan. 27, 2005

(30) Foreign Application Priority Data

Jul. 25, 2003 (JP) ..... 2003-280181

(51) Int. Cl.
*H01J 7/44* (2006.01)

(52) U.S. Cl. ..... 315/56; 315/57; 362/265

(58) Field of Classification Search ..... 315/291, 315/209 R, 76, 82, 57–70, 77, 85, 276, 282, 315/289, 56; 336/198, 192, 200, 65; 362/221, 362/265, 65, 201, 260
See application file for complete search history.

(56) References Cited

U.S. PATENT DOCUMENTS

| | | | | |
|---|---|---|---|---|
| 6,049,163 | A * | 4/2000 | Masuda et al. | 313/318.12 |
| 6,066,921 | A * | 5/2000 | Nakamura et al. | 315/71 |
| 6,084,354 | A * | 7/2000 | Kohmura et al. | 315/57 |
| 6,429,591 | B1 * | 8/2002 | Takamatsu et al. | 315/56 |
| 6,731,076 | B1 * | 5/2004 | Gerhard et al. | 315/289 |
| 6,856,227 | B2 * | 2/2005 | Ushio et al. | 336/198 |

FOREIGN PATENT DOCUMENTS

| | | | |
|---|---|---|---|
| EP | 1189314 | A1 * | 3/2002 |
| JP | 2001-102142 | A | 4/2001 |

* cited by examiner

*Primary Examiner*—Thuy V. Tran
*Assistant Examiner*—Jimmy T Vu
(74) *Attorney, Agent, or Firm*—Sughrue Mion, PLLC

(57) ABSTRACT

A through hole that is slightly larger than a size of a rear end of a transformer container is formed in a rear cover constituting a part of an external wall of a starting circuit unit. The transformer container houses therein a transformer and constitutes a transformer portion. The transformer portion is assembled such that a rear end of the transformer container projects from the through hole. This allows the transformer container to constitute a part of the external wall of the starting circuit unit.

9 Claims, 5 Drawing Sheets

DISCHARGE LAMP LIGHTING DEVICE

BACKGROUND OF THE INVENTION

1. Field of the Invention

The present invention relates to a discharge lamp lighting device having a starting circuit unit that integrally includes a socket on which a discharge lamp is mounted and a starting circuit for starting the discharge lamp.

2. Description of the Related Art

Recently, a discharge lamp (HID lamp) has been used as a light source of a headlamp for a motor vehicle use. For example, JP 2001-102142 A discloses, as a discharge lamp lighting device for lighting such a discharge lamp, a discharge lamp lighting device having a starting circuit unit in which a socket on which a discharge lamp is mounted and a starting circuit for starting the discharge lamp are integrally provided, and all internal constituent components in the unit are covered with an external wall.

The starting circuit of the discharge lamp lighting device has a high voltage transformer generating a high-voltage pulse necessary to start its discharge lamp. Such a high voltage transformer calls for covering itself with a member such as a container or a barrier plate aimed insulating its high voltage portion. For this reason, a high voltage transformer is previously configured as a component that has no exposed high voltage portion, and then the transformer generating high voltage is covered along with other circuits with a cover which is separately fabricated beforehand, thereby uniting a discharge lamp lighting device as a socket for connecting a discharge lamp having a built-in starting circuit.

Meanwhile, in a discharge lighting device for a vehicle, the higher the function of a vehicle, the larger the number of components mounted in an engine room is. As a result, in a recent discharge lamp lighting device for a vehicle use, a space around a headlamp tends to be narrowed. Therefore, there is great need for size reduction of a discharge lamp lighting device. Particularly, it shows a marked trend toward a discharge lamp lighting device having a starting circuit unit in which a socket and a starting circuit are integrally provided because of an extremely large size of the unit placed at the back of the discharge lamp.

In order to achieve such size reduction with the existing discharge lamp lighting device, it has no other choice but to thin thickness of the cover out of a double-layered wall, i.e., a barrier plate for insulating the transformer generating high voltage and the cover constituting an external wall of the starting circuit unit. However, to use as a cover, thinning the thickness of the cover to excess is absolutely nonsense for lack of its stiffness, and one strikes against technical bounds in fabricating a thin cover from the beginning. Therefore, there has been unsurmountable bounds as far as one takes the foregoing conventional structure.

SUMMARY OF THE INVENTION

The present invention has been made to solve the above-mentioned problems. A main object of the present invention is to provide a discharge lamp lighting device whose size can be reduced without thinning thickness of a cover constituting an external wall of a starting circuit unit of the device.

A discharge lamp lighting device according to the present invention includes a starting circuit unit for lighting a discharge lamp, wherein a wall constituting a transformer of the starting circuit unit is taken as a part of the external wall of the starting circuit unit.

Therefore, according to the present invention, the wall constituting the transformer of the starting circuit unit is taken as a part of the external wall of the starting circuit unit. Therefore, a double-layered portion in the conventional discharge lamp lighting device can be formed with a wall of the transformer only, which reduces a size of the discharge lamp lighting device.

DETAILED DESCRIPTION OF THE PREFERRED EMBODIMENT

A preferred embodiment of the present invention will now be described below with reference to the attached drawings.

First Embodiment

Figure 1:
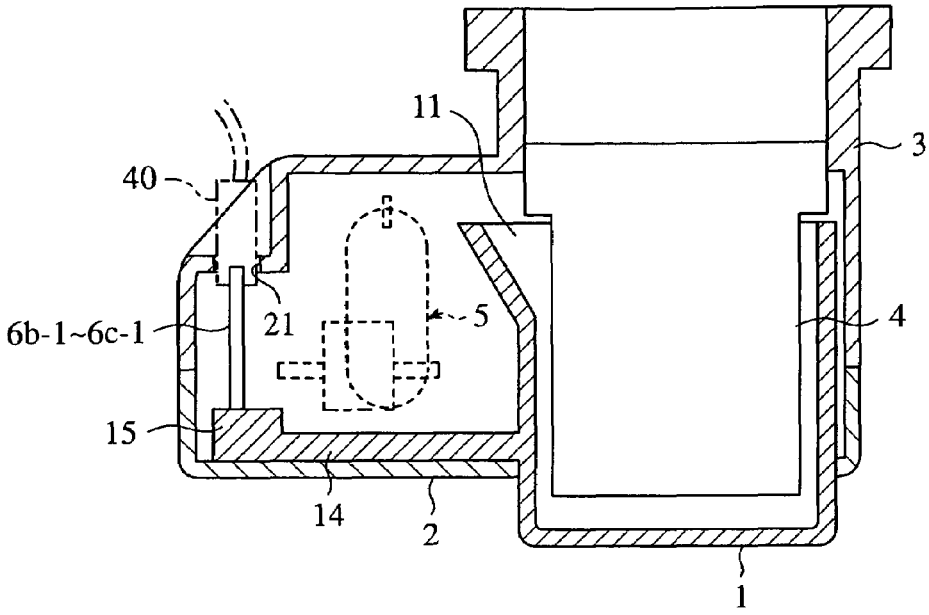
FIG. 1 is a sectional view showing a discharge lamp lighting device according to a first embodiment of the present invention.

FIG. 1 is a sectional view showing a discharge lamp lighting device according to the first embodiment of the present invention.

Figure 2:
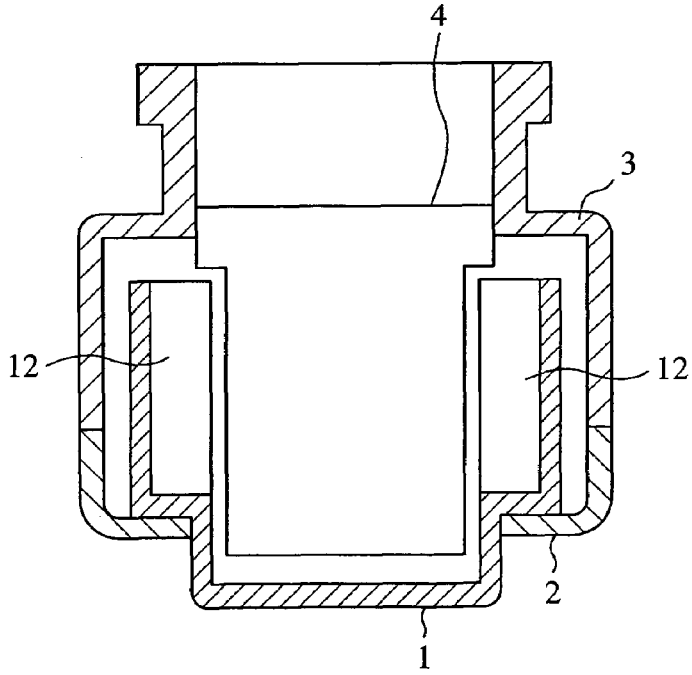
FIG. 2 is a sectional view showing a resin-pool of the discharge lamp lighting device.

FIG. 2 is a sectional view showing a resin pool of the discharge lamp lighting device.

FIG. 3 to FIG. 7 are exploded perspective views of the discharge lamp lighting device.

These figures show a starting circuit unit in the discharge lamp lighting device. As shown in the figures, the starting circuit unit is composed of a transformer container 1, a rear cover 2, a front case 3, a transformer 4, an electronic part 5, and a lead frame 6.

Figure 6:
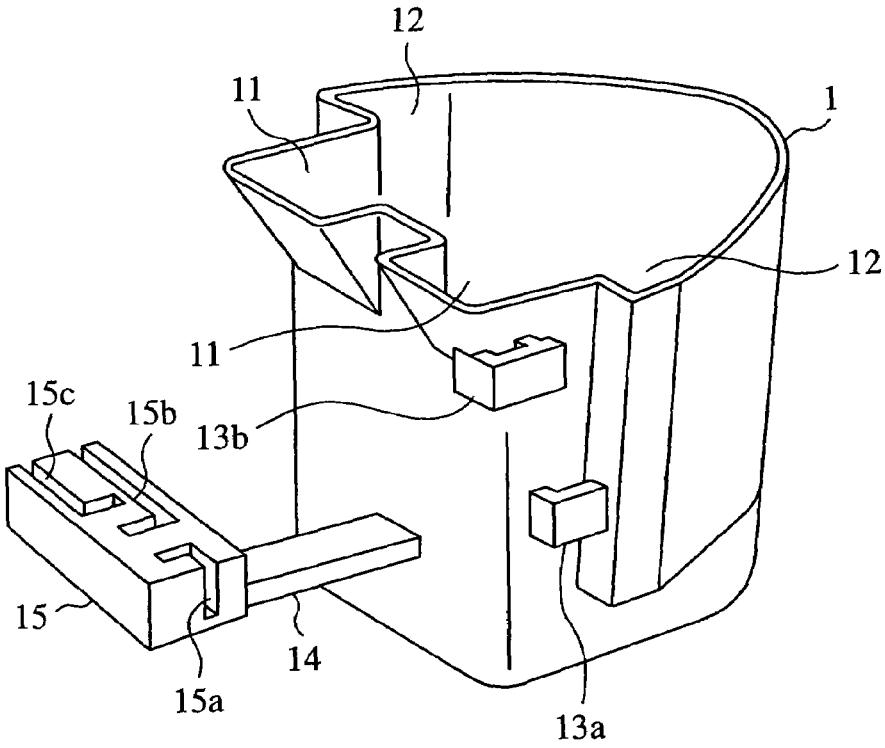
FIG. 6 is a perspective view showing a transformer container of the discharge lamp lighting device.

The transformer container 1 constitutes a transformer portion together with the transformer 4 and is made of plastics constituting an external wall of the transfer portion. Further, as shown in FIG. 6, the container has a resin-injecting inlet 11 and a resin pool 12, and further integrally has engaging protrusions 13*a*-13*c* and a beam 14 for supporting the lead frame 6. In this figure, the engaging protrusion 13*c* is located at the back of the transformer container 1 and so the protrusion is not shown. The transformer container 1 monolithically molded to integrally form the resin-injecting inlet 11, the resin pool 12, the engaging protrusions 13*a*-13*c*, and the beam 14.

The resin-injecting inlet 11 is formed at the opening end of the transformer container 1 and takes a funnel shape. Two resin-injecting inlets are formed on the mounting side of the electronic part 5 (on the left side in the figure). That is, the resin-injecting inlet 11 has a shape that extends toward the opening end of the transformer container 1. The resin pool 12 is a space formed by outwardly convexly projecting a part of the transformer container 1 such that a space larger than interstices of other portions exits when the columnar transformer 4 is received in the transformer container 1. The resin pool is formed at two places of the transformer container 1 so as to locate the both sides of the resin-injecting inlet 11.

The engaging protrusions 13*a*-13*c* are protrusions provided at places where the engaging clicks 28*a*-28*c* of the lead frame 6, which will be described later, are engaged. The beam 14 is for supporting the lead frame 6 projectingly provided on the electronic part 5 side, and at the tip of which grooves 15*a*-15*c* where the respective pieces of the lead frame 6 are inserted or supported are provided in a lead frame supporting portion 15.

Figure 7:
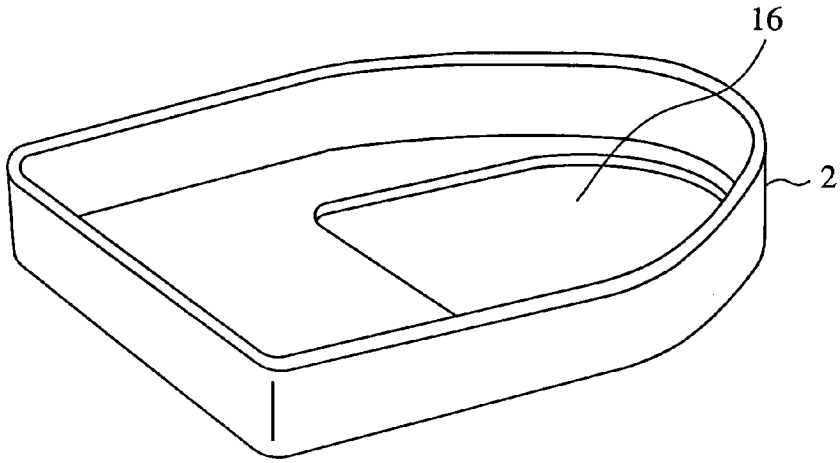
FIG. 7 is a perspective view showing a rear cover of the discharge lamp lighting device.

As shown in FIG. 7, the rear cover 2 is a cover having a through hole 16, which is somewhat larger than the bottom of the transformer container 1 so as to pass through the bottom of the transformer container. Through the structure of the discharge lamp lighting device thus arranged as mentioned above, when respective constituent parts are assembled, the transformer container 1 projects from the through hole 16, and thereby the bottom of the transformer container 1 constitutes a part of an external wall of the starting circuit unit.

Figure 3:
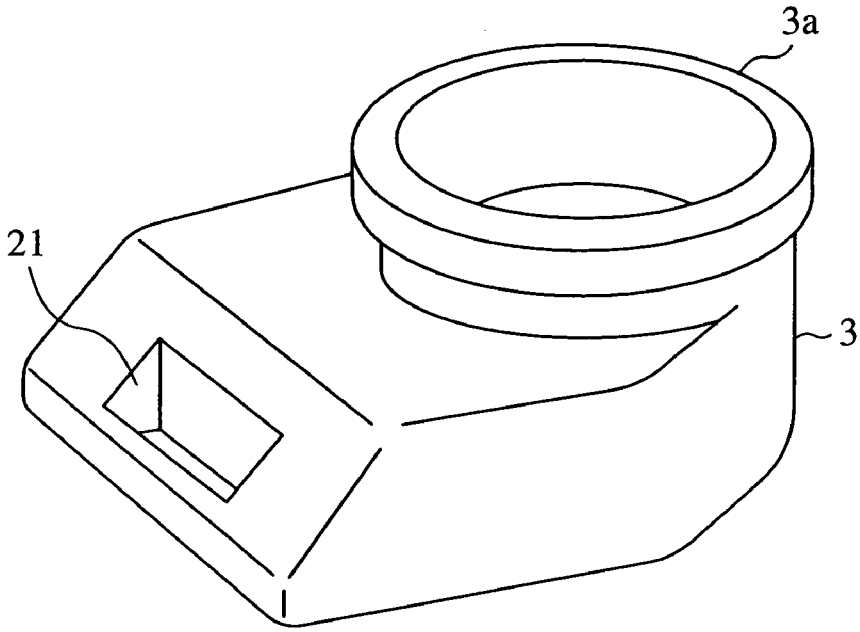
FIG. 3 is a perspective view showing a front case of the discharge lamp lighting device.

The front case 3 shown in FIG. 3 includes a cylinder 3*a* constituting a socket for mounting thereon a discharge lamp (HID lamp) (not shown), and has functions as the front cover of the starting circuit unit and as holding the lead frame 6. Moreover, the front case has a connector-inserting hole 21 for inserting a connector for supplying power to the starting circuit unit.

Figure 4:
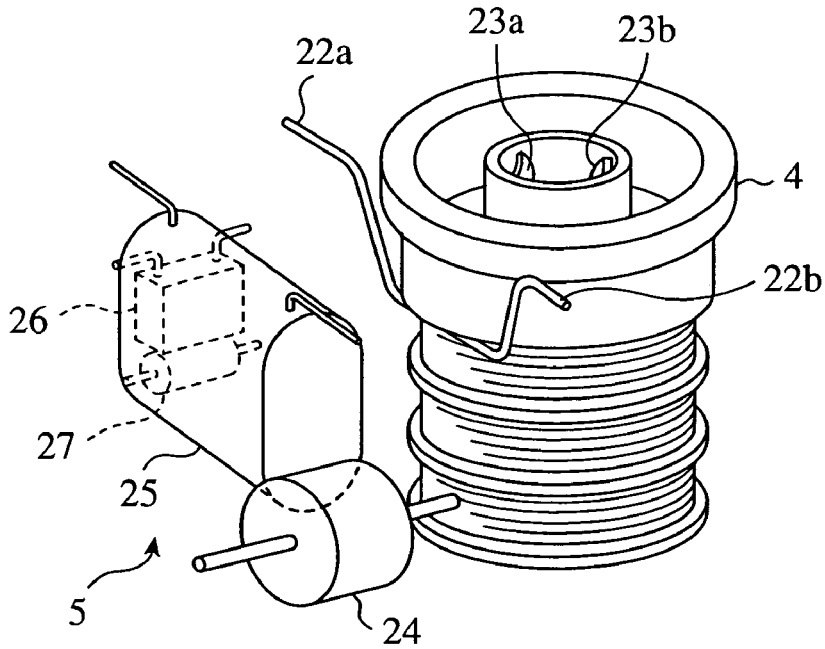
FIG. 4 is a perspective view showing a transformer and electronic part of the discharge lamp lighting device.

The transformer 4 shown in FIG. 4 is a transformer which is formed by winding a primary coil and a secondary coil around its coil bobbin for generating high voltage for starting the discharge lamp, and has lead wires 22*a* and 22*b*. Furthermore, the transformer integrally has high voltage terminals 23*a* and 23*b* on which the discharge lamp is connected. In passing, an internal configuration of the transformer 4 is well known, and hence a detailed description thereof is omitted for brevity's sake. The transformer 4 is housed within the transformer container 1, and into which resin is injected to integrally secure these members, thereby forming the transformer portion.

The electronic part 5 is an electronic part constituting the starting circuit, and is composed of components such as a switching element 24, a capacitor 25, another capacitor 26 for a noise filter, and a choking coil 27 for the noise filter as shown in FIG. 4. In passing, the starting circuit composed of the electronic part 5 has a similar configuration to the conventional one, and hence a detailed description thereof is omitted for brevity's sake.

Figure 5:
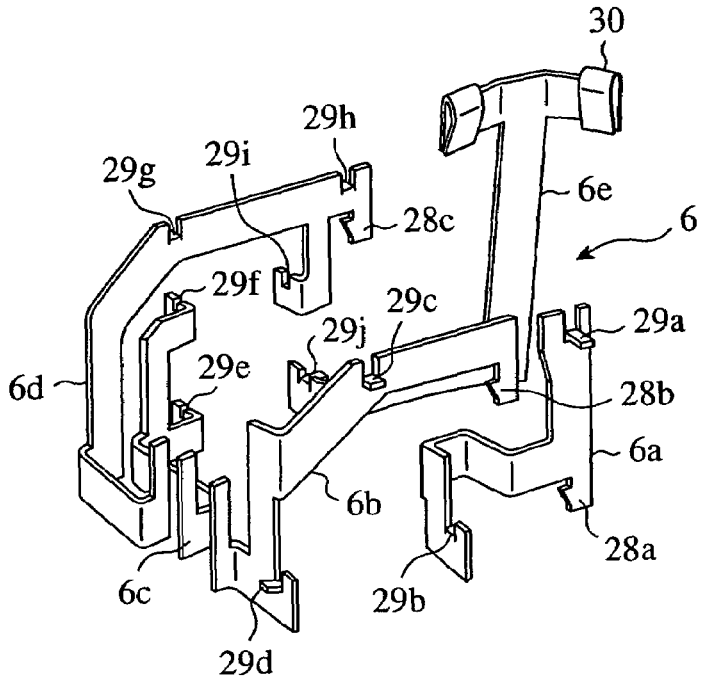
FIG. 5 is a perspective view showing a lead frame of the discharge lamp lighting device.

The lead frame 6 shown in FIG. 5 is made of metallic plates, such as copper and partakes both functions of supporting the electronic part 5 and of wiring between the electronic part 5, and is composed of five lead-frame pieces 6*a*-6*e*. The lead frame 6 has engaging clicks 28*a*-28*c* for engaging the engaging protrusions 13*a*-13*c* of the transformer container 1, and further has bent protrusions 29*a*-29*j* for connecting with the lead wires of each electronic part 5. These bent protrusions 29*a*-29*j* are formed by cutting and raising, at a nearly right angle, a part of each of the lead-frame pieces 6*a*-6*e*. Moreover, the lead-frame piece 6*e* constitutes a low voltage terminal 30 for supplying power to the discharge lamp.

In the starting circuit unit, in order to insulate and to increase strength and resistance to vibrations of the transformer 4, liquid resin is injected into a space between the transformer 4 and the transformer container 1, and then the resin cured, thereby forming a transformer part in which the transformer container 1 and the transformer 4 are integrally bonded to each other. Here, because the resin has high viscosity, when the resin is to be injected through the space between the transformer container 1 and the transformer 4 as in the past, workability goes wrong for its narrowness of the space therebetween. By contrast, according to the first embodiment, as shown in FIG. 1 and FIG. 6, the formation of the funnel shaped resin injecting inlet 11 facilitates an injecting operation and increases the workability by injecting resin through the resin-injecting inlet 11.

Moreover, as shown in FIG. 2 and FIG. 6, the provision of the resin pool 12 in the transformer container 1 conduces to an increase likewise in the workability at the time of injecting the resin.

As described above, since the resin to be injected has high viscosity, it takes some time for the injected resin to reach every small hole and corner. Such being the case, it is necessary to slowly perform a resin injecting operation in the past by spending a comparatively long time. In contrast, according to the first embodiment, since the resin pool 12 having a comparatively large volumetric capacity is provided, the injected resin is received at first in the resin pool 12, even if the resin is injected in a rather large amount for a short time. The resin received in the resin pool 12 is thereafter reach every small hole and corner. Therefore, the resin injecting operation, in particular, an operation time of the injecting nozzle, is shortened.

Further, the injected resin expands or shrinks by a thermal difference when the injected resin is cured. At that time, the provision of the resin pool 12 enables the resin remaining in the portion 12 to absorb an expansion or shrinkage of the resin, which prevents an overflow of the resin from the transformer container 1, or avoids a shortage of the resin after the resin is cured. Furthermore, although gas is generated from the resin while the resin is being cured, the generated gas can be more easily discharged through the space of the resin pool 12 to atmosphere, thereby solving a problem that voids remain within the cured resin.

The assembly of the starting circuit unit according to the first embodiment involves mounting the lead frame 6 on the transformer part after fabricating the above transformer part, and joining the electronic part 5 to the lead frame 6. When the lead frame 6 is mounted on the transformer container 1, each lead-frame pieces 6*a*-6*e* are supported by the transformer container 1 as described below.

Figure 8:
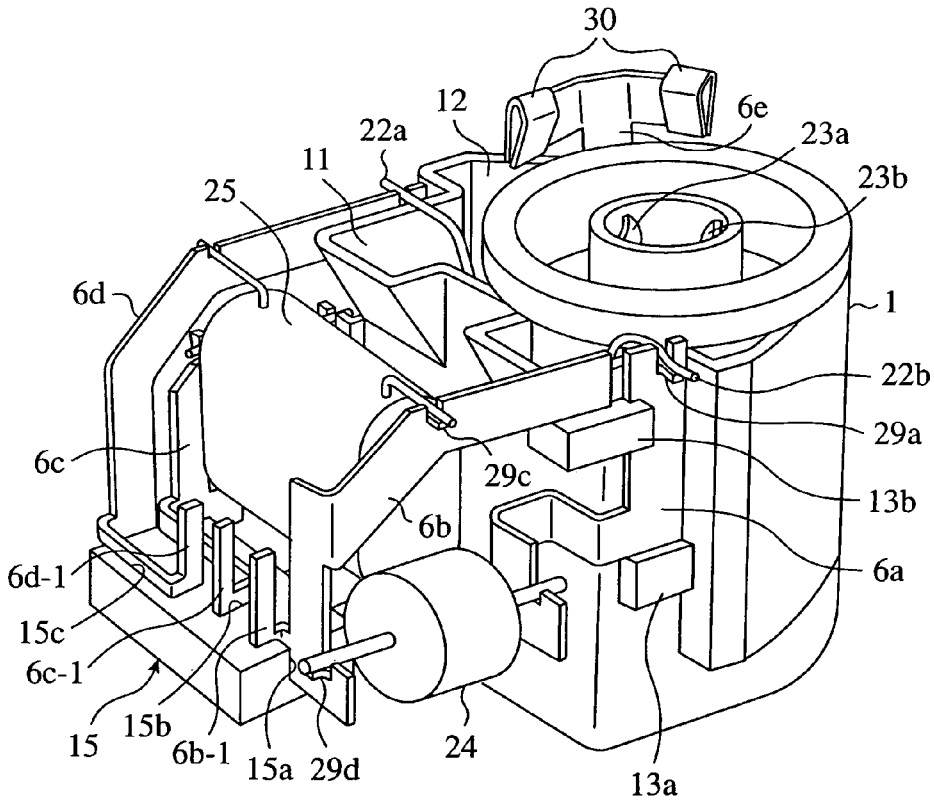
FIG. 8 is a perspective view showing a state in which the electronic part and the lead frame are assembled to the transformer of the discharge lamp lighting device.

For example, the engaging click 28*a* of the lead-frame piece 6*a* shown in FIG. 5 is inserted in the engaging protrusion 13*a* from above the figure of the transformer container 1 shown in FIG. 6, and thereby the engaging protrusion 13*a* and engaging click 28*a* are engagingly held as shown in FIG. 8. Moreover, the engaging click 28*b* of the lead-frame member 6*b* are engagingly held with the engaging protrusion 13*b* of the transformer container 1, and the end on another side of the engaging click 28*b* is inserted in the groove 15*a* of the lead frame supporting portion 15. In a similar manner, the lead-frame piece 6*c* is inserted in the groove 15*b*. Further, one end of the lead-frame member 6*d* is inserted in the groove 15*c*, the engaging click 28*c* thereof on the other end is engagingly held with the engaging protrusion 13*c* (not shown), and the lead-frame member 6*e* are supported by the transformer container 1 by means of engagingly holding means (not shown) In the lead-frame pieces 6*b*-6*d*, partial portions 6*b*-1, 6*c*-1, and 6*d*-1 of the portion supported by the lead frame supporting portion 15 are connector terminals into which a connector 40 (see FIG. 1) is inserted.

Thus, after the lead-frame pieces 6*a*-6*e* are each assembled to the transformer container 1, the electronic part 5 is assembled to each of the lead-frame pieces 6*a*-6*e*. Places to be assembled, e.g., of the lead wires 22*a*, 22*b* of the transformer 4 are the bent protrusions 29*a*, 29*h*, respectively. In a similar manner, the lead wires of the switching device 24 are assembled to the bent protrusions 29*d*, 29*b*; the lead wires of the capacitor 25 to the bent protrusions 29*c*, 29*g*; the lead wires of the capacitor 26 for a noise filter to the bent protrusions 29*f*, 29*i*; and the lead wires of the choking coil 27 for the noise filter to the bent protrusions 29*e*, 29*j*.

FIG. 8 is a perspective view showing a state in which the electronic part 5 and the lead frame 6 are assembled to the transformer.

The illustrated state shows a state in which the lead frame 6 is assembled to the transformer container 1, and the electronic part 5 to the lead frame 6. The lead wires of each electronic part 5 are assembled on the bent protrusions 29*a*-29*j* of the lead frame 6 so as to lie one upon another as shown in FIG. 8. Here, in the lead-frame pieces 6*a*-6*e* are provided with slits (notches for forming the bent protrusions 29*a*-29*j*) for inserting the lead wires of the electronic part 5, which facilitates positioning of the electronic part 5.

The lead wires of the electronic part 5 are laid on the bent protrusions 29*a*-29*j* of the lead-frame pieces 6*a*-6*e*, respectively, and then the terminals of the lead wires and the bent protrusion 29*a*-29*j* are joined by welding. That is, tips of the lead wires and those of the bent protrusions 29*a*-29*j* are heated and melted, to thereby join each other.

Figure 9:
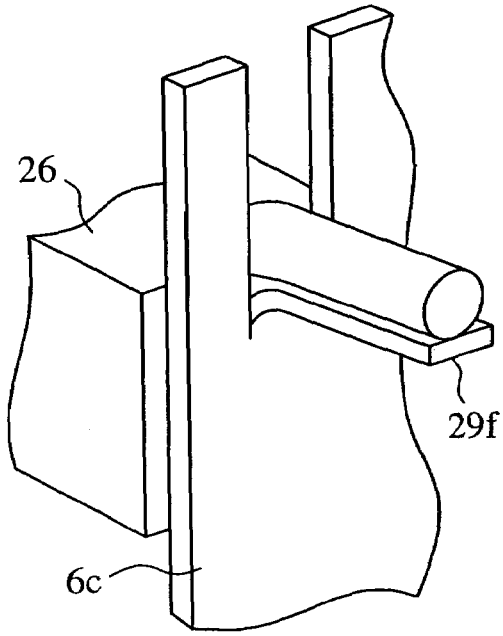
FIG. 9 is a perspective view showing a state in which the lead wire and the bent protrusion of the discharge lamp lighting device have not yet joined.

FIG. 9 is a perspective view showing a state in which the lead wires and the bent protrusions have not yet jointed to each other.

Figure 10:
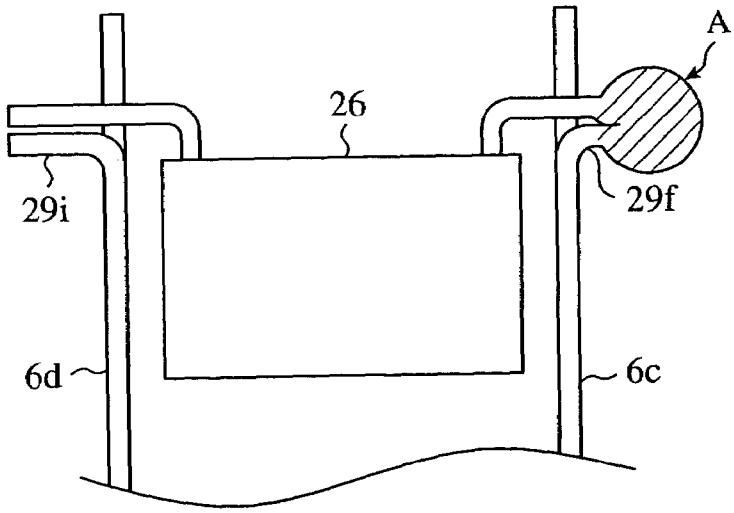
FIG. 10 is an explanatory view showing a state in which the lead wire and the bent protrusion of the discharge lamp lighting device are joined to each other.

FIG. 10 is an explanatory view showing a state in which the lead wires and the bent protrusions are jointed to each other.

Here, a portion is shown as one example where each lead wire of the capacitor 26 for the noise filter is joined to the bent protrusion 29*f* and bent protrusion 29*i*.

The bent protrusions 29*a*-29*j* are partially cut and raised so as to have the width substantially equal to diameter of the lead wire thereof as shown to FIG. 9. Therefore, when their tip portions are heated, the heat applied for melting the portions is hard to escape in the direction of the lead frame 6, which easily melts for welding of the lead wire and the bent protrusion. Arrow A in FIG. 10 shows a state after they are joined to each other.

Such a joint structure securely fixes the electronic part 5 to the lead frame 6. Even the on-board discharge lamp lighting device requiring high reliability against vibrations sufficiently meets a demand thereof. Moreover, the electronic part 5 and the lead frame 6 joined to each other by welding eliminates a space for an electrode as with resistance-welding and gives liberty to design a shape of the lead frame 6 and a layout of the electronic part 5.

After the electronic part 5 and the lead frame 6 are joined, the front case 3 and the rear cover 2 are attached, respectively. FIG. 1 and FIG. 2 illustrate this state. As shown in FIG. 2, the external rear end surface of the resin pool 12 abuts on the rear cover 2, and a rear portion of the transformer container 1 projects from the through hole 16. Thereby, the rear portion of the transformer container 1 constitutes a part of an external wall of the starting circuit unit together with the rear cover 2 and the front case 3. Therefore, an axial length of the starting circuit unit can be shortened by an amount equivalent to the thickness of the rear cover 2. Further, the front case 3 abuts on the front end surface (the upper end surface shown in FIG. 8) of the lead frame 6, and the lead frame 6 is held by the front case 3. Moreover, as shown in FIG. 1, abutment of the rear cover 2 on the rear end surface of the beam 14 holds the lead frame 6 in a condition where the frame is sandwiched between the rear cover 2 and the front case 3 through the beam 14.

As shown in a broken line in FIG. 1, the connector 40 extending from a power circuit (not shown) is inserted into the connector-inserting hole 21 of the front case 3, and connected with the connector terminals 6*b*-1, 6*c*-1, and 6*d*-1 of the lead-frame pieces 6*b*-6*d*.

Although the through hole 16 is formed in the rear cover 2, other portions have a normal wall thickness. Accordingly, there is particularly no problem about a strength required for the starting circuit unit. In addition, though the transformer container 1 projects from the rear cover 2, the protrusion is insulated as the transformer container 1. Therefore, there is no problem about a protection of the high voltage portion.

As mentioned above, since according to the first embodiment, the discharge lamp lighting device is arranged such that the through hole 16 is formed in the rear cover 2, the transformer container 1 is projected from the through hole 16, and the transformer container 1 is taken as a part of the external wall of the starting circuit unit, an axial length of the starting circuit unit can be shortened. Therefore, the overall depth of the entire headlamp can be reduced, and thereby obtaining increased freedom of an arrangement or layout of the discharge lamp lighting device when the device is used particularly for a vehicle.

Moreover, the funnel shaped resin-injecting inlet 11 is formed in the opening end of the transformer container 1. This facilitates a resin injection and promotes efficiency of the injecting operation.

Further, the provision of the resin pool 12 in the transformer container 1 shortens the time of an injecting operation, and stabilizes a state where the resin is cured.

In addition, the lead frame 6 is provided, which partakes both functions of wiring for electrically connecting the electronic part 5 and of supporting these electronic part 5, and the lead frame 6 is supported by the transformer container 1. This eliminates the need of a substrate for electrically connecting the electronic part 5, and thereby reducing a size and weight of the discharge lamp lighting device. Additionally, the lead frame 6 is fabricated separately from the transformer container 1, and thereafter the frame is assembled to the container. This enables transportation of the transformer container by hand when manufacturing the device, which frees from loading of a weight of the transformer on the lead frame 6 itself, and enables satisfactory secureness of the lead frame to the container by simple securing means. Thus, the reliability of the discharge lamp lighting device can be improved.

Moreover, it is arranged such that the transformer container 1 is provided with the beam 14, and the lead frame 6 is assembled using the beam 14 in the subsequent process to support the lead frame 6, thereby tightly assembling the lead frame 6 to the transformer container 1 without toppling.

Further, the lead frame 6 can be separately designed, which easily adapts it to an unexpected design change after the device is completed.

Additionally, the lead frame 6 and the electronic part 5 are joined by welding. Therefore, a juncture therebetween can have superior durability when used at high temperature, e.g., compared with that formed by soldering that melts at comparatively low temperature. This improves the durability and reliability of the discharge lamp lighting device.

In addition, the bent protrusions 29*a*-29*j* having a width substantially equal to a line diameter of a lead wire of the electronic part 5 is provided in the juncture between the lead frame 6 and the electronic part 5, and these bent protrusions 29*a*-29*j* and the lead wires of the electronic part 5 are simultaneously melted and joined. This brings about secure joint therebetween though the joint is comparatively easy, and also improves the durability and reliability of the discharge lamp lighting device.

What is claimed is:

1. A discharge lamp lighting device comprising:

a starting circuit unit;

a transformer;

a transformer container which receives the transformer; and a cover which receives the starting circuit unit, the cover having a hole therethrough through which the transformer container projects such that the cover and a bottom of the transformer container together constitute an external wall of the starting circuit unit, wherein a portion of a wall of the transformer container that is opposite the bottom of the transformer container projects outward from the transformer to form a resin-injecting inlet such that a distance from the transformer to an outer edge of the portion of the wall is greater than a distance from the transformer to an outer edge of the transformer container.

2. The discharge lamp lighting device according to claim 1, wherein a space where resin pools is formed by outwardly projecting a portion of the transformer container.

3. The discharge lamp lighting device according to claim 1, further comprising a lead frame, which includes wiring of an electronic part of the starting circuit unit, and which supports the electronic part, the lead frame being supported by the transformer.

4. The discharge lamp lighting device according to claim 3, wherein a beam supporting the lead frame is provided in the transformer container for integrally mounting the lead frame on the transformer.

5. The discharge lamp lighting device according to claim 3, wherein the lead frame is joined with the electronic part by welding.

6. The discharge lamp lighting device according to claim 5, wherein a bent protrusion having a width substantially equal to a line diameter of a lead wire of the electronic part is provided in a portion which is to be a part juncture portion of the lead frame, and the bent protrusion and the lead wire are simultaneously melted and joined.

7. The discharge lamp lighting device according to claim 1, wherein the portion of the wall of the transformer container is in the shape of a spout.

8. A discharge lamp lighting device comprising a starting circuit unit for lighting a discharge lamp, wherein a wall constituting a transformer of the starting circuit unit is taken as a part of an external wall of the starting circuit unit, and wherein a means for receiving resin into the transformer container is formed in the opening end of the transformer container constituting an external wall of the transformer wherein a portion of a wall of the transformer container that is opposite the bottom of the transformer container projects outward from the transformer to form a resin-injecting inlet such that a distance from the transformer to an outer edge of the portion of the wall is greater than a distance from the transformer to an outer edge of the transformer container.

9. The discharge lamp lighting device according to claim 8, wherein a means for pooling resin is formed in a transformer container constituting an external wall of the transformer.

* * * * *